United States Patent [19]

Neufuss et al.

[11] Patent Number: 4,707,379

[45] Date of Patent: Nov. 17, 1987

[54] PROTECTIVE LAYER FOR CARBONACEOUS MATERIALS AND METHOD OF APPLYING THE SAME

[75] Inventors: Karel Neufuss; Aleš Macků; Antonín Forejt, all of Praha; Pavel Kasík, Plzeň, all of Czechoslovakia

[73] Assignee: Ceskoslovenska akademie ved, Czechoslovakia

[21] Appl. No.: 812,964

[22] Filed: Dec. 24, 1985

[51] Int. Cl.[4] ..... B05D 1/10

[52] U.S. Cl. ..... 427/34; 427/113; 427/78

[58] Field of Search ..... 427/34, 113, 423, 78

[56] References Cited

U.S. PATENT DOCUMENTS

| | | | |
|---|---|---|---|
| 3,140,380 | 7/1964 | Jensen | 427/34 X |
| 3,348,929 | 10/1967 | Valtscheu et al. | 427/113 |
| 3,669,723 | 6/1972 | Parr et al. | 427/423 X |
| 4,386,112 | 5/1983 | Eaton et al. | 427/423 |

FOREIGN PATENT DOCUMENTS

| | | | |
|---|---|---|---|
| 583199 | 12/1977 | U.S.S.R. | 427/113 |

*Primary Examiner*—Shrive P. Beck

*Attorney, Agent, or Firm*—Jeffers, Hoffman & Niewyk

[57] ABSTRACT

A protective layer for carbonaceous materials, especially graphite electrodes, applied by plasma-coating method comprised of 65–98 w/o of metal aluminum, 1–20 w/o of combined metal silicon with silica ($SiO_2$) and up to 15 w/o of oxygenous compounds of aluminum. The resistivity of the layer is $0.07.10^{-6}$ ohm.m up to $0.3.10^{-6}$ ohm.m at 20° C. and $0.12.10^{-6}$ ohm.m up to $0.7.10^{-6}$ ohm.m at 400° C.

The method of producing the protective layer comprises the following steps of directing a plasma flame of a water stabilized plasma burner toward the carbonaceous material, and feeding into a plasma flame a particulate composition comprising between about 85 w/o to about 99 w/o of metallic aluminum having a particle size of between about 0.09 to about 0.180 mm and between about 1 to about 15 w/o of silicon having a particle size of between about 0.07 to about 0.165 mm.

10 Claims, No Drawings

PROTECTIVE LAYER FOR CARBONACEOUS MATERIALS AND METHOD OF APPLYING THE SAME

BACKGROUND OF THE INVENTION

This invention concerns a protective layer for carbonaceous materials, namely graphite electrodes, that is used to prevent lateral burn-offs during smelting in electric arc furnaces. The invention also concerns the method of producing this protective layer.

Metallic and ceramic protective layers, and also layers made of combined metal and ceramic, are well known. Their formulas change according to the desired characteristics of the protective layer. The metallic layers are used when the substrate is to be protected against corrosion or when the substrate surface is to be electrically conductive. The ceramic protective layers are used when high temperatures are involved or when abrasion is to be prevented. The combined metal-ceramic protective layers retain the characteristics of both the metallic and ceramic layers.

However, in some cases, the properties of the above named protective layers are not sufficient such as in the case of a graphite electrode used in electric arc furnaces when the layer is required to protect the base material against corrosion at high temperatures and at the same time provide for electric current feeding to the base material.

It is known that at more than 600° C. there is an evident burn-off in graphite electrodes. The literature (e.g., Hutnik 1/1980, page 12) gives the properties of burn-off as follows: 0.7 kg/m$^2$ at 600° C.; 5.5 kg/m$^2$ at 1000° C.; and 10 kg/m$^2$ at 1600°.

According to the German patent No. 127/ 007/, it is possible to use a protective layer containing aluminum, silicon carbide and other heat resistant materials.

German Pat. No. 1,671,065 provides protective layers consisting of a basic layer formed mainly of silicon and a top layer containing mostly aluminum. These layers are applied by flame spraying.

According to German patent application No. 2,722,438, it is also well known to provide a protective layer where there is a fiber interlayer between the basic and top layers according to the German Pat. No. 1,671,065.

In the Soviet authorship No. 827 460, a protective layer is mentioned made of a composition of $TiB_2$ and water glass applied on the electrode and then for 3–10 minutes processed by a plasma fusion at 3000°–6000° C., anode voltage 9–10 kV and anode current 3.8–5 A, while the plasma flame is 80–800 mm long.

The Czechoslovakia AC (Authorized Certificate) No. 217 720 presents a protective layer based on oxide ceramics and metal filler, e.g., copper or nickel.

The British patent No. 1,419,302 and the Bulgarian AC No. 11029 describe a production method for a protective layer on carboneous products, namely on electrodes. First, the aluminum layer is metallized on the products and then at normal heat, e.g., with a metal-spraying gun, a paste of aluminum, silicon carbide, titanium dioxide and boric acid is sprayed over and baked by electric arc; then comes the second metallizing with a second layer of paste and the second baking by electric arc. Then this layer is metallized with aluminum again, a graphite layer is applied and baked over, and then the product is polished.

The layers which are known so far are showing lower adhesion to graphite, especially at more than 800° C., when heated and cooled in alternating cycles. Often cracks appear and the layer starts peeling off. Sometimes the layers peel off during the storage of electrodes. Some layers, as well as some methods of production, are rather complicated and demanding in production, and this are economically undesirable. In some protective layers there occurs a change of resistivity during storage.

SUMMARY OF THE INVENTION

An object of the invention is to provide a plasma sprayed protective layer for carbonaceous materials, especially graphite electrodes, consisting of 65–98% of weight of metallic aluminum, 1–20% of weight of combined metallic silicon and silica, and up to 15% of weight of oxygeneous aluminum compounds, and a method for applying the protective layer.

In one form thereof, the invention is directed to a protective layer for a carbonaceous material applied by plasma coating techniques, comprising the composition of about 65 w/o to about 98 w/o of metallic aluminum, about 1 w/o to about 20 w/o of combined metallic silicon and silica and up to about 15 w/o of oxygeneous aluminum compounds.

In another form thereof, the invention is directed to a method for producing a protective layer for a carbonaceous material characterized by directing a plasma flame of a water stabilized plasma burner toward the carbonaceous material, and feeding about 85 w/o to about 99 w/o of aluminum having a particle size of between about 0.09 to about 0.180 mm and about 1 to about 15 w/o of silicon having a particle size of between about 0.07 to about 0.165 mm into a plasma flame of a water-stabilized plasma burner.

DETAILED DESCRIPTION OF THE INVENTION

The invention is directed to a plasma sprayed protective layer for carbonaceous materials, such as graphite electrodes, wherein the protective layer consists of about 65 w/o to about 99 w/o of metallic aluminum, between about 1 w/o to about 20 w/o of combined metallic silicon and silica, and up to about 15 w/o of oxygeneous aluminum compounds.

This layer according to this invention is electrically conductive with resistivity of $0.07.10^{-6}$ up to $0.3.10^{-6}$ ohm.m at 20° C. and $0.12.10^{-6}$ up to $0.7.10^{-6}$ ohm.m at 400° C. The thickness of layer is also advantageously 0.3 mm up to 1.5 mm. The specific weight of the layer is 1900–2300 kh/m$^3$. Resistivity after the first cycle of heating at 400° C. and cooling at 20° C. decreases by 10–15%, and during the second cycle of heating at 400° C. and cooling off, the resistivity does not change any further.

According to this invention, the protective layer is produced as described below. Into a plasma flame, preferably generated by a water-stabilized plasma burner, is fed about 85 w/o to about 99 w/o of aluminum having a particle size of between about 0.09 mm and about 0.180 mm and between about 1 w/o to about 15 w/o of silicon having a particle size between about 0.07 mm and about 0.165 mm. These metals may be fed in the flame either separately or in a mixture.

It is very important to select the proper particle size of materials fed in. Should the particles fed in the plasma be too big, a porous layer with higher resistivity will result. The smaller the sprayed particles, the lower the resistivity. However, this is valid up to a certain point. Once a certain resistivity value has been reached, the resistivity starts to rise again even when the size of particles should be further decreased. The increase in resistivity when small particles are plasma-sprayed is caused by the increasing fraction of oxygeneous compounds generating by the overheated particles of material fed into the plasma stream.

For a better effectiveness of spraying it is possible to feed the aluminum and silicon into the plasma stream through one or more, preferably two or three, inlets placed around the plasma flame at regular distances. The feeding can be performed by means of compressed air or any other compressed gas media. It is advantageous to use, e.g. nitrogen, carbon dioxide, hydrogen, argon, propane-butane, acetylene, etc., so as to be able to decrease the oxidation of overheated particles of material sprayed. The above named gases can be used separately or in combination.

The most effective speed of plasma coating is between about 0.3 and about 0.8 $m.s^{-1}$ and the total quantity of material fed into plasma is between about 12 to about 60 kg/hour. According to the desired thickness of protective coating it is possible to repeat the spraying several times, optimally twice to four times.

Silicon plasma-sprayed together with aluminum enhances the adhesivity of the layer at high temperatures, causes a chemical bond between the layer and the carbonaceous material, and at high temperatures enhances the resistivity of the protective coating.

To reach the above characteristics, the optimal quantity of silicon applied is between about 5 w/o to about 10 w/o. To produce the protective coat according to this invention, it is possible to use technical silicon (e.g., silicon containing 96%–99% Si) and technical aluminum of current quality.

The protective layer produced according to this invention is especially high-temperature resistant and also has the characteristic of good adhesivity to the carbonaceous material at temperatures higher than 800° C. during the heating and cooling cycles. No cracks occur and the layer will not peel even during a longer storage time of layer-protected electrodes nor during their application in arc furnaces.

The production method according to this invention is simple and effective.

The layer is perfectly conductive both when cold and warm. Its resistivity does not change during shelf-life. The protective coat according to this invention can be produced as described above on all carbonaceous materials, both on flat and cylindrical surfaces (also of the smallest diameters, e.g. 3 mm) as for example: graphite cover plates, closures, melting crucibles, electrodes for arc furnaces of various diameters (both disposable and for continuous use), burn-out electrodes, etc.

EXAMPLES

Example No. 1

On a roughened electrode having a diameter of 350 mm and a length of 1800 mm, a protective layer 0.45 mm thick with a resistivity of $0.136.10^{-6}$ ohm.m at 20° C. and a specific weight of 2 120 $kg/m^3$ was applied by a plasma burner with an output of 160 kW. The coating constituents comprised 92 w/o of aluminum wherein a third of the aluminum was of a particle size between 0.09 to 0.118 mm and two-thirds of the aluminum was of a particle size between 0.118 and 0.175 mm; and 8 w/o of silicon having a particle size of between 0.071 to 0.112 mm. This composition was fed into the plasma flame at a rate of 13 kg per hour. The plasma fusion was performed in three runs having a duration of four minutes each from a distance of 220–250 mm at 35 electrode revolutions/minute wherein the spraying speed was 0.62 m/second. The electrode was then mounted on an arc furnace for alloy steels and carbonaeous steels smelting having a capacity of forty tons. Graphite electrode savings was 15–20%.

Example No. 2

On a roughened electrode of a diameter of 350 mm and a length of 1800 mm, a protective coat 0.5 mm thick was applied having a resistivity of $0.115.10^{-6}$ ohm.m at 20° C. and a specific weight of 2180 $kg/m^3$ by means of a plasma flame having an output of 160 kW. The coating constituents comprised a mixture of 94 w/o of aluminum having a particle size of 0.09 mm to 0.180 mm and 6 w/o of silicon having particle size of 0.071 mm to 0.112 mm. This mixture was fed in from two feeding locations facing each other at a rate of 13 kg/hour per feeding location for a total rate of feed equal to 26 kg/hour. The plasma fusion process was performed in two runs of 3.5 minutes each from a distance of 230–250 mm and at a spraying speed of 0.45 m/second. The electrode was mounted in an arc furnace having a capacity of forty tons for smelting medium alloy steels and carbonaceous steels and the savings in graphite electrodes was 18%.

Example No. 3

On a roughened graphite electrode of a diameter of 100 mm and a length of 1200 mm, a protective coat 0.7 mm thick was applied having a resistivity of $0.20.10^{-6}$ ohm.m at 20° C. and a specific weight of 2070 $kg/m^3$ was applied by means of a water stabilized plasma flame having an output of 160 kW. In this case, granulated aluminum powder of a particle size of between about 0.118 to about 0.175 mm was fed in from one feeding location at a rate of 13.6 kg/hour while silicon having a particle size of 0.112 to 0.165 mm was fed in from a different feeding location at a rate of 2.4 kg/hour. The aluminum powder comprised 85 w/o of the coating composition and the silicon comprised 15 w/o of the composition. The two feeding locations were oppositely disposed from each other. The plasma fusion process was performed in two runs of the burner at a distance of 240 mm and a spraying speed of 0.71 m/second. The electrode was used in burning up the tap-hole of an arc furnace for silicon melting. At higher temperatures there appeared no oxidative corrosion nor was the cross-section thereof thinned in the critical spot. Substantial reduction of loss of electrodes caused by fracture was also noticed. Savings on graphite electrodes was about 35%.

Example No. 4

On a roughened graphite electrode of a diameter of 100 mm and a length of 1200 mm, a protective coat 0.5 mm thick was applied having a resistivity of $0.17.10^{-6}$ ohm.m at 20° C. and a specific weight of 2080 $kg/m^3$ was applied by means of a water stabilized plasma flame having an output of 160 kW. The coating constituents comprised the combination of 90 w/o of aluminum having a particle size of between about 0.09 and 0.180 mm and 10 w/o silicon having a particle size of 0.071 to 0.165 mm. This particulate combination was fed in by three inlets symmetrically disposed around the plasma flame wherein the feeding rates for the inlets were 15 kg/hour, 16 kg/hour and 18 kg/hour. The plasma fusion process was performed in one sole run of a duration of 90 seconds and at a spraying speed of 0.96 m/second from a distance of 200 mm. The electrode was then used in burning up the tap-hole of an arc furnace for silicon melting. The electrode did not show any lateral burn-offs and the loss caused by fracture has been substantially reduced. Graphite electrode savings reached 33%.

While there have been described above the principles of this invention in connection with specific apparatus, it is to be clearly understood that this description is made only by way of example and not as a limitation to the scope of the invention.

What is claimed is:

1. A method for producing a protective layer on a carbonaceous material by plasma coating comprising the steps of:

directing a plasma flame of a water stabilized plasma burner toward the carbonaceous material, and feeding into the plasma flame a composition comprising between about 85 w/o to about 99 w/o of aluminum having a particle size of between about 0.09 mm to about 0.180 mm, and about 1 w/o to about 15 w/o of silicon having a particle size of between about 0.07 mm to about 0.165 mm.

2. The method according to claim 1 wherein the layer is applied at a speed of between about 0.3 to about 0.8 m/second and the material is fed into the plasma flame at a rate of between about 12 kg/hour to about 60 kg/hour.

3. The method according to claim 1 wherein the feeding of the particulate composition into the plasma flame is through a single location.

4. The method according to claim 1 wherein the feeding of the particulate composition is through a plurality of inlets.

5. The method according to claim 4 wherein said plurality of inlets is equi-spaced about the plasma flame.

6. The method according to claim 2 wherein the feeding of the particulate composition into the plasma flame is through a single location.

7. The method according to claim 2 wherein the feeding of the particulate composition is through a plurality of inlets.

8. The method according to claim 7 wherein said plurality of inlets is equi-spaced about the plasma flame.

9. The method according to claim 1 wherein the particulate mixture is fed into the plasma flame by compressed gas medium.

10. The method according to claim 9 wherein the gas medium is selected from the group consisting of the following gases: air, nitrogen, carbon dioxide, hydrogen, argon, propane-butane or acetylene.

* * * * *